United States Patent [19]

Jones

[11] 4,106,878

[45] Aug. 15, 1978

[54] FIRE-RATED CEILING GRID CROSS JOINT

[75] Inventor: Paul H. Jones, Willow Grove, Pa.

[73] Assignee: National Rolling Mills Company, Malvern, Pa.

[21] Appl. No.: 765,733

[22] Filed: Feb. 4, 1977

[51] Int. Cl.[2] ..... F16B 7/22

[52] U.S. Cl. ..... 403/28; 403/346; 52/664

[58] Field of Search ..... 403/347, 28, 252, 382, 403/403; 52/DIG. 5, 667, 664, 726

[56] References Cited

U.S. PATENT DOCUMENTS 3,501,185 3/1970 Brown et al. ..... 403/252 X

*Primary Examiner*—Wayne L. Shedd

*Attorney, Agent, or Firm*—Smith, Harding, Earley & Follmer

[57] ABSTRACT

A grid for a fire-rated suspended ceiling includes a plurality of identical parallel spaced main beams and a plurality of identical parallel spaced cross tees supported by the main beams, the main beams and cross tees each having a substantially inverted T cross section and each including coupling means integral with the ends thereof, the coupling means for each main beam featuring a laterally offset tongue and an integral offset bulb end portion that is crushed to reduce its lateral dimension and to form a stiffening rib, whereby relative is facilitated.

14 Claims, 8 Drawing Figures

FIRE-RATED CEILING GRID CROSS JOINT

BACKGROUND OF THE INVENTION

1. Field of the Invention

This invention relates to improvements in fire-rated suspended ceiling constructions in which a metallic grid system is suspended from primary ceiling members and is used to support acoustical tiles or other ceiling boards or panels.

2. Description of the Prior Art

In general, suspended ceilings employ acoustical or other boards that are fire resistant or fire retardant. With the constructions that have been proposed in the prior art, however, the ability of such ceilings to provide protection against fire from below has been limited by the metallic main beams or main runners and the cross tees or cross runners that form the grid by which the boards are supported. The main beams and cross tees are generally made of metal having appreciable positive temperature coefficients of expansion and consequently tend to expand and buckle from the heat generated by fires. As a result of such expansion and buckling, boards are displaced from their position of support by the main beams and cross tees, thereby exposing the area above the suspended ceiling to the fire from below.

Various proposals have been made in the prior art for modifying suspended ceiling grids for accommodating the stress of main beam and cross tee expansion so as to maintain the proper support of the ceiling boards even during a condition of excessive heat as would be caused by a fire. The prior art proposals to accommodate, and hence, avoid the adverse effects of undue stress in the main beam and cross tee grid structure of a suspended ceiling have generally involved an attempt to control the expansion such as by weakening the main beams of a grid by slitting or cutting away portions or by providing an additional reinforcing and splicing plate or member at the coupling of the main beams. Suspended ceiling grid structures utilizing one or another of these techniques are shown in U.S. Pat. Nos. 3,175,655, 3,189,139, 3,457,688, 3,807,111, and 3,890,760. However, the weakening of the main beams detracts substantially from the rigidity of the grid and its capacity to support the ceiling boards without appreciable sagging. The use of reinforcing splice plates adds undesirably both to inventory and installation problems as well as to cost of materials. The use of heavier gauge metal to strengthen the main beams and cross tees has also been proposed. Such a solution to the problem, however, is impracticable as prohibitively expensive.

SUMMARY OF THE INVENTION

Accordingly, among the objects of the present invention is the provision of an improved fire-rated suspended ceiling grid system that is operative to accommodate the stress of main beam and cross tee expansion upon excessive heating resulting from a fire in a manner that does not detract from the rigidity of the grid structure, and its capacity to support the ceiling boards without sagging.

An additional object of the invention is the provision of such a grid structure for a suspended ceiling in which the main beam and cross tees are multi-directional, that is the main beams are all identical to each other and the cross tees are all identical to each other.

A further object of the invention is the provision of a structure that provides increased strength at the coupling between main beams arranged substantially in end to end relation without requiring the use of heavier gauge metal for the main beam.

Another object of the invention is the provision of an improved cross tee featuring a lance on the cross tee connection tongue to prevent pull out of the cross tee from the main beam when transversely or oppositely disposed cross tees are seated in a supporting slot provided in the main beam;

A further object of the invention is the provision of an improved cross tee featuring:

(a) a 30° angle on the bottom of the end of the cross tee bead or bulb for causing the end of the cross tee upon expansion of the latter due to excessive heat caused by a fire, to ride up into the air over the main beam bulb, thus allowing such expansion of the cross tee without bowing or twisting; and (b) the provision of a curve on the leading or extending portion of the cross tee bulb whereby upon ramping up of the ends of cross tees oppositely disposed with respect to a main beam such cross tee ends go right by each other over the bulb of the main beam and do not block the expansion of the cross tees.

A still further object of the invention is to provide in such an improved cross tee structure a shoulder on the cross tee tongue to keep the cross tee from being dislodged by workmen from its proper position with respect to the main beam.

In accomplishing these and other objects, there is provided improvements in the grid of a fire-rated suspended ceiling system comprising multi-directional main beams and cross tees. The coupling ends of the main runners are all identical to each other. Similarly, the coupling ends of the cross runners are all identical to each other. This facilitates manufacture and ease of stocking and inventory problems as only two grid components, main beams and cross tees, are required.

The main beams according to the present invention are characterized in their structural arrangement which provides increased strength at the interconnection or coupling between main beams, such increased strength being obtained without requiring the use of heavier gauge metal for the webs of the main beams. This improvement in strength is obtained by crushing the tubular bulb of the main beam above the connecting tongue that is provided, thereby providing a strengthening rib. This avoids the need to cut off the tubular bulb above the connecting tongue as taught by the prior art, but posed an offset problem, as is described hereinafter, the novel solution of which includes moving the offset crease line that is provided back and away from the connector tongue of the main beam.

There is also provided an improved cross tee featuring a lance on the cross tee connector tongue to prevent pull out of the cross tee from the main runner when oppositely disposed cross tees are seated in the slot provided for their support in the main beam. Additionally, a 30° angle is provided on the bottom of the end of the cross tee tubular bulb. This causes the cross tee, bulb end, upon expansion of the cross tee, to ride up into the air over the main beam bulb. As a result, longitudinal expansion of the cross tee is allowed without any tendency of the cross tee to bow or twist. Further, there is provided a slight bend or curve, on the end of the cross tee bulb. As a result upon the application of excessive heat, and the ramping up of the cross tee with respect to the main beam, the oppositely disposed cross tee bent bulb ends go right by each other and do not block the expansion.

BRIEF DESCRIPTION OF THE DRAWINGS

A better understanding of the present invention may be had from the following detailed description when read in connection with the accompanying drawings wherein.

DESCRIPTION OF THE PREFERRED EMBODIMENTS

Figure 1:
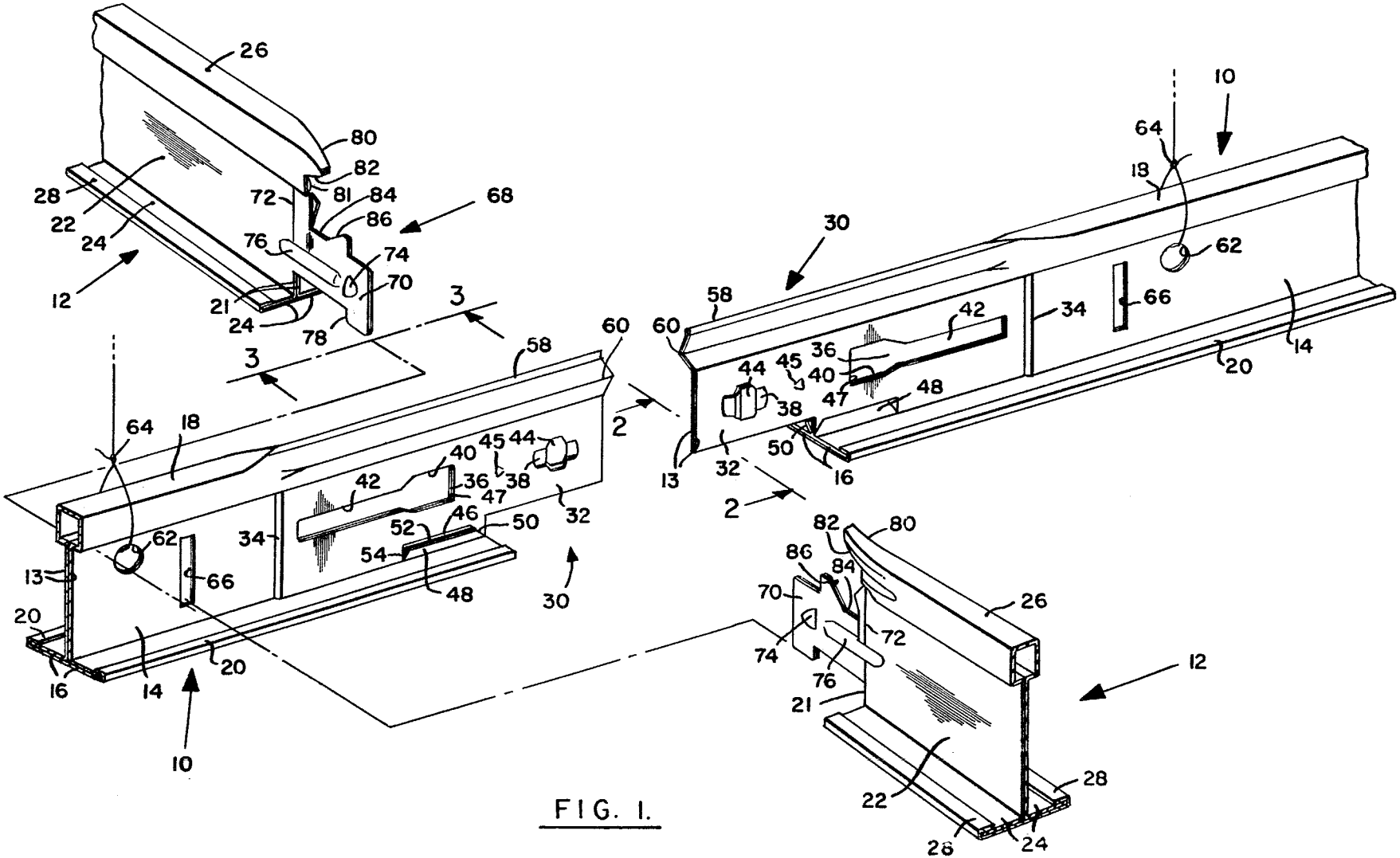
FIG. 1 is a fragmentary, perspective view of a portion of a fire-rated suspended ceiling grid, including a pair of man beams and a pair of cross tees embodying the present invention, illustrating particularly the means provided to couple the main beams in end-to-end relation, and the means provided to couple the cross tees to the main beams.

Referring to FIG. 1 there is shown a pair of main beams or main runners each of which is designated by the numeral 10, and a pair of cross tees or cross runners each of which is designated by the numeral 12. As used in a suspended ceiling grid structure, the main beams 10 are arranged in spaced-apart, substantially parallel, relationship with a plurality of cross tees 12 extending between and interconnecting adjacent main beams 10.

The pair of main beams 10 shown in the drawing are identical to each other. Therefore, in order to avoid unnecessary complication of the drawing and description, the same reference numerals are employed herein to identify the various component parts of the main beams 10 shown in the several figures of the drawing. Similarly, the pair of cross tees 12 are identical to each other and for the same reason the same reference numerals are employed herein to identify the various components parts thereof.

As seen in FIG. 1, each main beam 10 is formed of a sheet of base metal and has an inverted T construction. Each main beam 10 includes an elongated upright web 14 having spaced parallel marginal edges 13, a pair of flanges or edges 16 that are offset to both sides of the lower edge of web 14, and an integral strengthening or reinforcing elongated bead or bulb 18 extending along the top edge of the web 14. When installed in a suspended ceiling grid structure, the oppositely disposed flanges 16 support ceiling boards or panels as is conventional. A separate decorative capping 20 is mounted on the flanges 16. Similarly, each cross tee 12, formed of a sheet of base metal, has an inverted T construction, and includes an elongated upright web 22 having spaced parallel marginal edges 21 and provided with integral flanges 24 offset to both sides of the lower edge of web 22, and an integral strengthening of reinforcing elongated bead or bulb 26 extending along the top edge of the web 22. A separate decorative capping 28 is mounted on the flanges 24.

At each end of the main beam 10 there is provided an identical integral coupling means, indicated generally by the numeral 30, of such configuration that either end of a main beam 10 may be coupled with either end of a similar main beam 10. The coupling means 30 at each end comprises a tongue 32 extending from the end of the upright web 14 and joined therewith at an offset crease line 34. The tongue 32 extends parallel to the upright web 14 and is offset laterally at the offset crease line 34 relatively to the web 14 by an amount approximating the thickness of the web 14, as is apparent from a consideration of FIGS. 1 and 2.

The coupling means 30 at each end of the main beam 10 includes a key slot 36 and a butterfly clasp 38 formed in the tongue 32. The slot 36 and clasp 38 are arranged in spaced relation parallel to the flanges 16 and bulb 18 of each main beam 10, with the clasp 38 adjacent the end of the tongue 32. Each key slot 36 includes a keyway portion 40 of height sufficient to allow upper and lower retaining tabs 44 of the butterfly clasp 30 of the adjacent main beam 10 to pass through keyway portion 40 when the tongues 30 of the adjacent main beams 10 are brought into close, parallel, side-by-side relationship to each other. The key slot 36 also includes an elongated slot 42 that extends to a position closely adjacent to the offset crease line 34. The height of the elongated slot 42 is less than that of the keyway portion 40 whereby the upper and lower retaining tabs 44 of the butterfly clasp 38 of the tongue 30 of one of the main beams 10 are adapted to engage the upper and lower edges, respectively, of the elongated slot 42 of the coupling means 30 of the other main beam 10 whereby to hold the adjacent tongues 32 in close parallel and firm engagement with each other, thus preventing any relative lateral or vertical movement between main beams 10 as thus coupled in end-to-end relation.

Tongue 32 of each main beam 30 is also provided with a locking lance 45. The edges of locking lances 45 of connected main beams 10 are in abutting relationship with the vertical edges 47 of keyway 40 to prevent the connected beams 10 from being pulled apart accidentally.

Because of the provision of the offset crease line 34, the coupled main beams 10 are aligned longitudinally with each other. That is to say, there is longitudinal alignment between the upright webs 14, flanges 16 and bulbs 18, as is apparent from consideration of FIGS. 4, 5 and 8.

The coupling means 30 of the main beams 10 are effective to prevent any relative lateral and vertical movement between the coupled main beams 10. The coupling means 30, however, allow relative longitudinal movement of the coupled main beams 10, such movement as would tend to occur upon longitudinal expansion of the main beams 10 due to exposure of the suspended ceiling grid system to excessive heat as in the case of a fire in the room. This desirable feature is achieved according to the present invention while maintaining desirable strength and rigidity of the main beams 10 at their coupling means 30. This minimizes any tendency of the main beams 10 to wiggle about in the region of their coupling means 30, even in the case of fire in the room below, while at the same time providing a desirable expansion relief means for the main beams 10.

Figure 2:
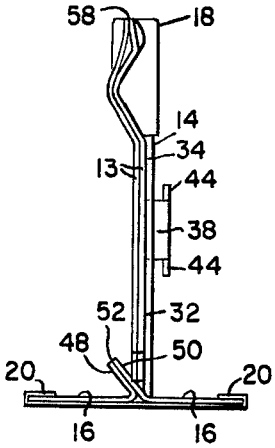
FIG. 2 is an end view of one of the main beams shown in FIG. 1, taken along the line 2—2.
Figure 4:
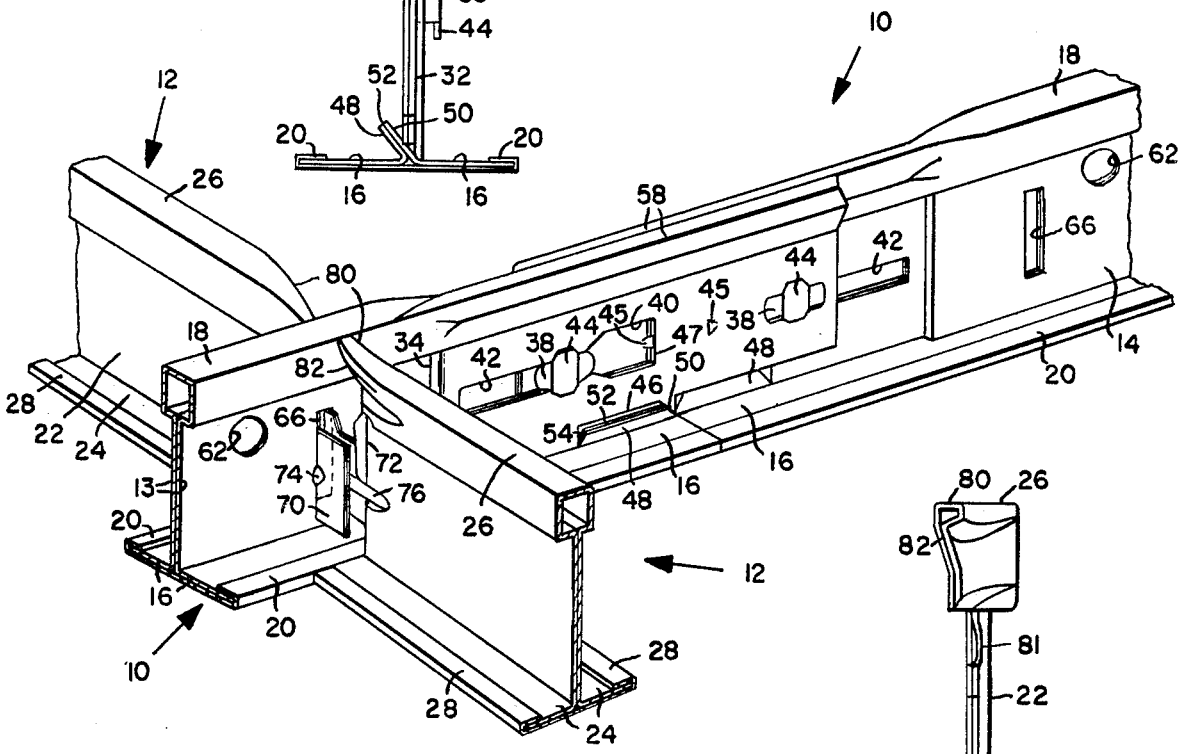
FIG. 4 is a fragmentary, perspective view of another portion of the fire-rated suspended ceiling grid according to the present invention including a main beam and two oppositely disposed cross tees in a properly coupled condition as when installed.

To this end the elongated slot 42, as seen by reference to FIGS. 1, 2 and 4, is sufficiently long to allow the retaining tabs 44 of the butterfly clasp 38 of the adjacent coupling means 30 to slide along the upper and lower edges of slot 42 as required to accommodate the expansion of the main beams 10 resulting upon exposure thereof to excessive heat.

By reference to FIG. 4, it is noted that in the normal locked position of the coupling means 30 of coupled main beams 10 the ends of the flanges 16 of the coupled main beams 10 abut each other. In order to prevent the adjacent flange ends from blocking movement of the coupled main beams 10 upon expansion thereof, thereby to provide the fire-rated feature of the main beams 10, the web 14 of each main beam 10 is cut at the bottom, adjacent the associated flange 16 to provide a slit 46. The slit 46 is at the end of each flange adjacent the tongue 32 and extends inwardly a short distance, as shown, from the end of the web 14. The slit 46, being cut in the web without the removal of any material, forms a rib 48 which extends upwardly from the flanges 16. Further, the rib 48 is bent slightly, as shown, to form an acute angle with respect to the upright web 14. The rib 48 includes an inclined edge portion 50, as seen in FIGS. 1 and 2, that extends upwardly at an acute angle with respect to the flanges 16. The rib 48 also includes a straight edge portion 52 which extends parallel to the flanges 16 and an edge portion 54 which extends perpendicularly from the line joining the upright web 14 and the flanges 16.

Figure 5:
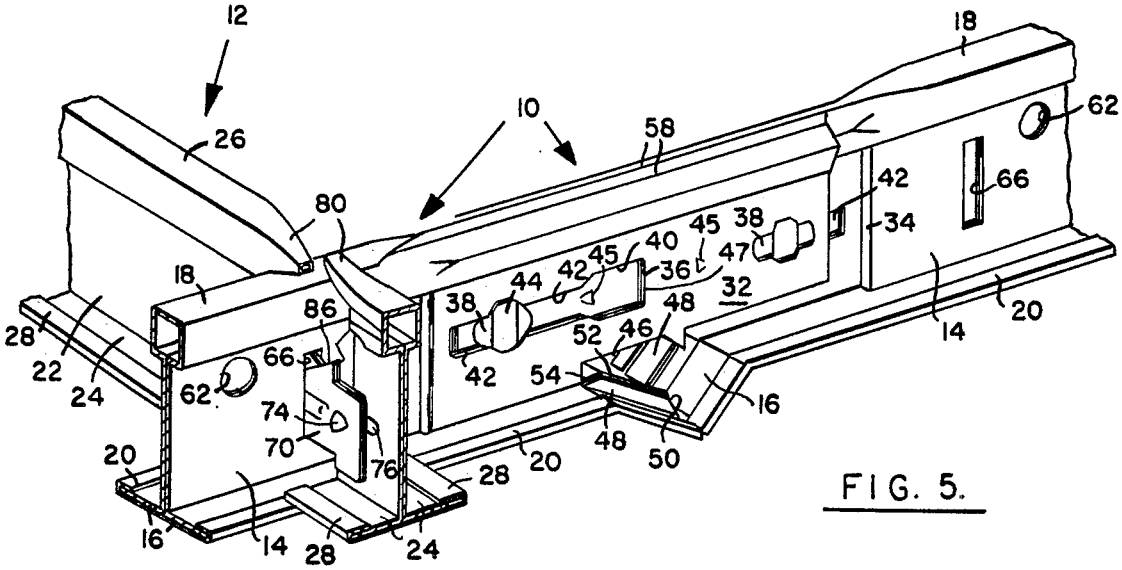
FIG. 5 is a fragmentary, perspective view of a portion of the ceiling grid structure embodiment of FIG. 4, illustrating the relative positions and conditions of the main beams 10 and the cross tees 12 after the main beams have been moved longitudinally relative to one another from their normal coupled position and after the cross tees have been moved longitudinally relative to one another, each from the normal coupled position.

During installation the main beams 10 are coupled in the manner illustrated in FIG. 4. As noted, however, upon the occurence of excessive temperature such as that resulting from a fire, the main beams 10 each tend to expand longitudinally and assume relative positions as illustrated in FIG. 5. The main means 10 are designed to accommodate this expansion movement by reason of the construction described. As the coupled main beams 10 move or expand longitudinally relatively to one another, the abutting ends of the flanges 16 of the main beams 10 are bent downwardly at the inner ends of the slits 46 as shown in FIG. 5. The provision of the slit 46 in the web 14 insures that the adjacent end portions of the flanges 16 move downwardly and not upwardly. The formation of the slit 46 to provide the inclined edge portion 50 on the end of the rib 48 also assures that the corner of the rib 48 does not oppose the downward movement of the bent end portions of the flanges 16. During the relative longitudinal movement of expansion of the main beams 10, the butterfly clasp 38 in the tongue 32 of a first one of the coupling means 30 moves along the elongated slot 42 of the adjacent coupling means 30.

The foregoing relative longitudinal movement of the main beams 10 occurs with little or no transverse movement of the main beams 10 along their length or in the region of the coupling means 30 whereby the ceiling boards or panels are maintained stable in their supported positions. This is an important feature of the fire-rated ceiling grid system of the present invention since the maintenance of the fire retardant ceiling grid boards in position prevents flames from a fire in the room below from reaching the area above the ceiling boards.

There has existed in the prior art, in connection with fire-rated suspended ceiling constructions, a serious problem in connection with the coupling means provided between main beams connected in end-to-end relation. This problem is concerned with the action of the stiffening and reinforcing bulbs provided which because of their size, alignment and stiffness tend to block the desired relative longitudinal expansion movement of the beams upon expansion thereof. A solution to this problem provided in the main beams for use in a suspended ceiling system disclosed in my prior U.S. Pat. No. 3,890,760, one of the patents above mentioned, involved cutting the ends of the bulbs back from the coupling means a distance sufficient to allow the necessary longitudinal expansion movement of coupled main beams upon exposure to excessive temperatures. Cutting the tubular bulbs away from the area of the coupling means for the main beams undesirably weakens the coupling, however, and allows the coupled main beams to wiggle about the coupling connection. This undesirably diminishes the necessary and important stability of the suspended ceiling grid system required to stably maintain the fire retardant ceiling boards and panels in place in the event of fire.

According to the present invention the problem of such undesired blocking bulb action is avoided by crushing the tubular bulb 18 at the end of the main beam in the region of the coupling means 30. Desirably, the tubular bulb 18 is crushed in such a manner as to reduce its lateral dimension and to provide a crushed reinforcing bulb portion indicated at 58. The bulb portion 58 extends parallel to the upper edge of the upright web 14 substantially the full distance from the end of the tongue 32 to the offset crease line 34. As shown in FIG. 1, the bulb portion 58 is provided with a rib 60 that strengthens the coupling means 30, particularly at the top of the tongue 32. The rib 60 and the tongue 32 are offset with respect to the web 14 at the crease line 34 whereby the ribs 60 of adjacent coupling means 30 do not interfere with bringing the coupling means 30 together in side-by-side parallel relationship and locking them in place by the cooperative action of the butterfly clasps 38 and the longitudinal slot 42, as described.

There has thus been provided a solution to the above mentioned problem that strengthens the coupling between main beams 10 instead of weakening the coupling, as in the prior art constructions, and that does not involve the need for additional stiffening plates or heavier gauge metal which might provide other but more expensive and less effective or desirable solutions.

As indicated by FIG. 1, a plurality of regularly spaced perforations 62 are provided in the upright web 14 of each of the main beams 10. Wire or other supporting means 64 may be looped through the perforations 62 for suspending the main beams 10 from primary ceiling members in a manner known in the art.

There are also provided, as indicated in FIG. 1, a plurality of upright or transverse rectangular cross tee connecting slots, indicated at 66, such slots being spaced at uniform intervals along the web 14 of the main beams 10. As explained hereinafter in further detail, the connecting slots 66 and the bulbs 18 of the main beams 10 are employed in such a manner in cooperation with a novel coupling means, indicated at 68, for the cross tees 12 as to provide a desirable and important expansion relief means in order that expansion of the cross tees 12 will not twist or buckle the main beams 10 to which they are attached, and further, to prevent lateral twisting or buckling of the cross tees 12 themselves under excessive heat conditions such as would be caused by fire.

Figure 3:
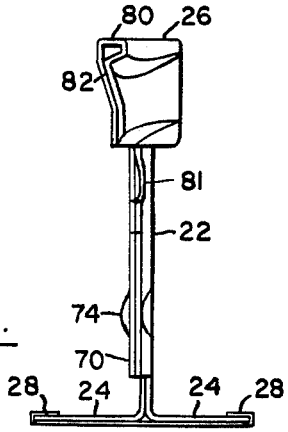
FIG. 3 is an end view of one of the cross tees shown in FIG. 1, taken along the line 3—3.

Specifically, by reference to FIG. 1, it is noted that the coupling means 68 of each cross tee 12 includes a connecting tongue 70 which is integral with the upright web 22 of the cross tee 12. The tongue 70 extends parallel to the upright web 22 and is offset laterally at an offset crease line 72 relatively to the web 22. The amount of the offset is approximately the thickness of the web 22, as is evident from a consideration of FIG. 3.

An important feature of the coupling means 68 provided for the cross tee 12 is a detent 74 that is formed in the connecting tongue 70. The purpose of the detent 74 is to firmly retain the connection of the cross tee 12 to the main beams 10, that is, to prevent pull out of the cross tees 12 from a main beam 10 when oppositely disposed across tees 12 are seated in a common supporting slot 66 in the main beam 10. A strengthening rib 76 is provided, said strengthening ribs 76 being substantially parallel to the flanges 24 of each cross tee 12 and extending substantially from the detent 74 into the web 22 for a short distance beyond the offset crease line 72.

The coupling means 68 for each cross tee 12 includes additionally, an anti-dislodging shoulder 78 that depends from the end of the connecting tongue 70. When cross tees 12 are installed in normal coupled relation to a main beam 10, the shoulder 78 engages the web 14 of the main beam 10 below the lower edge of the connecting slot 66. The purpose of the shoulder 78 is to avoid dislodging of the cross tees 12 from their proper coupled relation to a main beam 10, as for example, by workmen with installing the suspended ceiling grid system or when later removing a portion of the ceiling boards to gain access to plumbing, electrical or other equipment in the space above the suspended ceiling.

Figure 6:
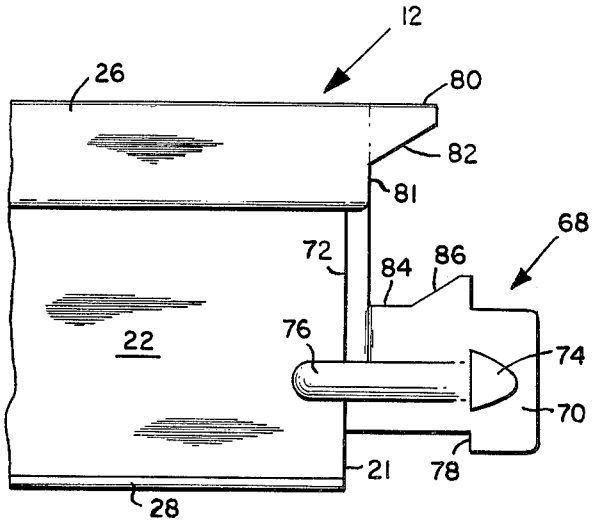
FIG. 6 is a side view of the coupling means provided for the cross tee shown in FIG. 1.
Figure 7:
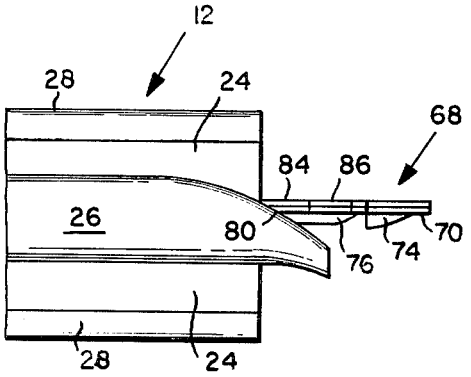
FIG. 7 is a top view of the coupling means provided for each of the cross tees shown in FIG. 1.

Another important feature of the coupling means 68 provided on the cross tee 12 is concerned with the extending crushed end portion, indicated by the numeral 80, of the tubular bulb 26. The end portion 80 of bulb 26 extends in the general direction of the connecting tongue 70, but includes a slight bend or curve, as shown in FIGS. 1, 4, 5 and 8. The bulb end portion 80, as seen particularly by reference to FIG. 6, is further characterized in the provision of an upward perpendicular cut, indicated at 81, substantially halfway through the bulb 26, and the provision of an edge indicated at 82 which is inclined at an angle of approximately 30° to the flanges 24 of the cross tee 12. Additionally, there is provided a notch 84 on the top of the connecting tongue 70, adjacent the web 22, and an edge 86 on the top of the tongue 70 that inclines upwardly at an angle of approximately 30° with respect to the flanges 24. With this arrangement, as will be evident upon consideration of FIGS. 4, 5 and 8, upon exposure of the cross tees 12 to excessive heat and subsequent longitudinal expansion thereof, the 30° inclined or ramp edge 82 causes the end portion 80 of the tubular bulb 26 to ride up in the air over the bulb 18 of the main beam 10. Additionally, during such upward movement of the end of the cross tee 12, the ramp edge 86 on the top of the connecting tongue 70 is maintained in tight engagement with the upper edge of the main beam connecting slot 66 in which the tongue 70 is installed. As a result, the cross tee 12 is maintained in firm and stable connection with the main beam 10, the longitudinal expansion of the cross tee 12 being allowed to take place without a bow or twist thereof.

A further and important feature of this construction resides in the provision of the slight bend in the extending end portion 80 of the tubular bulb 26 of the cross tee 12. This bend on the bulb end portion 80 is important in that when the cross tees 12 ramp up over the tubular bulb 18 of the main beam 10, from opposite sides thereof, the oppositely disposed cross tee bulb ends 80 are allowed to pass by each other, and hence, do not block or prevent longitudinal expansion of the cross tees 12.

Figure 8:
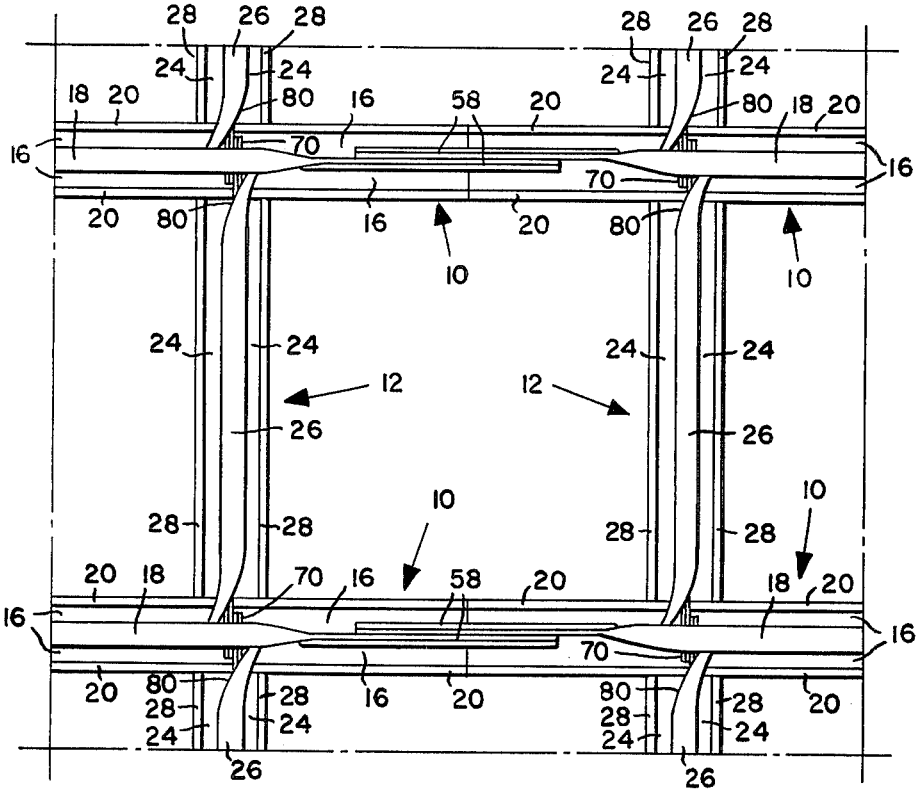
FIG. 8 shows a portion of a suspended ceiling grid embodying the principles of the present invention.

FIG. 8 is a schematic illustration of a portion of a suspended ceiling grid system including the structural main beam and cross tee components shown in FIGS. 1, 2, 3, 6 and 7. The rectangles outlined by a pair of spaced parallel main beams 10, such as shown in FIG. 1, and a pair of spaced parallel cross tees 12, also as shown in FIG. 1, are conveniently adjusted to correspond with the original dimensions of standard ceiling boards or panels, by way of example but not limitation, acoustic board having the dimensions of 6 inches × 6 inches, 12 inches × 12 inches or 24 inches × 48 inches. Such boards are conveniently supported in the frame so outlined with their marginal edges resting on the flanges 16 and 24 of the respective main beams 10 and cross tees 12. Viewed from the underside, particularly with the provision of the capping 20 for the flanges 16 of main beam 10 and the capping 28 for the flanges 24 of the cross tee 12, there is provided a decorative suspended ceiling that is characterized, importantly, by the advantage that in the event of fire, the supporting grid structure will maintain its installed stable relationship and will not become so distorted that the dimensions of the supporting grids will become greater than the dimensions of the board or panel members supported thereby thus permitting the latter to fall to the floor and thereby exposing the space above the suspended ceiling to the fire. As a result, notwithstanding a fire in the room below, a dead air space is maintained between the suspended ceiling and the main ceiling. This dead air space serves to insulate and protect the structure of the main ceiling from excessive temperatures that may exist in the room.

The suspended ceiling grid system of the present invention is particularly characterized in that each main beam section may be of substantial length, for example 20 feet, whereby the expansion of a long main beam section may be accumulated for such a long section and localized at the region of coupling of the main beams.

There has thus been provided an improved fire-rated suspended ceiling system which accommodates the stress of main beam and cross tee expansion upon excessive heating resulting from a fire. This improved system importantly is characterized by a structural arrangement that permits controlled expansion without detracting from the strength and rigidity of the grid structure and its capacity, therefore, to support the ceiling boards and panels without distortion or sagging, and without requiring the use of additional stiffening plates or heavier gauge metal for the main beams or cross tees. This controlled expansion structure further is characterized in that the main beams and cross tees employed are both multi-directional whereby all main beams may be identical to each other and all cross tees may be identical to each other, thus facilitating manufacture and minimizing stocking and inventory requirements.

I claim:

1. For use in a fire-rated suspended ceiling grid, a main beam comprising an elongated web with laterally offset flanges at one edge and a bulb at the other edge whereby said main beam has substantially an inverted T cross section, and coupling means integral with the main beam for connecting the end of said beam to the end of another similarly constructed main beam, said coupling means including a tongue at the end of said main beam, said tongue including portions of each of said web and of said bulb that are offset laterally relatively to the main portions of said web and bulb, with the said offset portion of said bulb being crushed to reduce its lateral dimension whereby said tongue may be brought into close parallel overlapping relation to the tongue of the coupling means of said another similarly constructed main beam with the main portions of said web and bulb and said flanges of said main beam and of such other similarly constructed main beam in longitudinal alignment, said coupling means further including retaining means to retain said tongue in such overlapping relationship with the tongue of the coupling means of such another main beam while allowing relative longitudinal movement of said beams.

2. For use in a fire-rated suspended ceiling grid, a main beam as specified in claim 1 wherein a longitudinal rib is formed in the said crushed offset portion of said bulb to strengthen said coupling means.

3. For use in a fire-rated suspended ceiling grid, a main beam as specified in claim 2 wherein said longitudinal rib extends substantially the length of the offset portion of said bulb.

4. For use in a fire-rated suspended ceiling grid, a main beam as specified in claim 3 wherein said retaining means comprises a clasp and a longitudinal slot on said tongue of said coupling means, said slot extending parallel to said crushed bulb portion in spaced longitudinal alignment with said clasp, said clasp and slot being adapted to cooperate with a similar longitudinal slot and similar clasp on the tongue of the coupling means of another similarly constructed main beam when said tongues are disposed in close parallel overlapping relationship to each other to couple said main beam to such another main beam.

5. For use in a fire-rated suspended ceiling grid, a main beam as specified in claim 4 wherein a slit is provided in the end of said web near the lower edge thereof, whereby upon expansion of a main beam beyond the normally coupled position the ends of the main beam flanges are caused to bend downwardly away from the web and are precluded from blocking such expansion.

6. For use in a fire-rated suspended ceiling grid, a main beam as specified in claim 5 wherein the lead-in portion of said slit slants downwardly from the main slit portion whereby upon main beam expansion the end of the main beam flanges are cammed downwardly.

7. For use in a fire-rated suspended ceiling grid, a cross tee comprising an elongated web with laterally offset flanges at one edge and a bulb at the other edge whereby said cross tee has an inverted T cross section, and coupling means for coupling said cross tee to a connecting slot provided in the web of a main beam with which said cross tee is associated in said grid, said coupling means including a tongue extending from the end of said web, said tongue being offset by a crease line from said web by an amount approximating the thickness of said web and including a detent thereon whereby said tongue and the tongue of a similarly constructed but oppositely disposed cross tee may be seated and firmly retained in close parallel relationship in the connecting slot of the associated main beam, and wherein an end portion of the bulb extends beyond said web, said portion being undercut and provided with an edge that inclines upwardly toward the end of said bulb portion, said bulb portion having a slight transverse bend and extending substantially to the bulb of the associated main beam with said cross tee and the associated main beam in normal coupled relation, whereby upn expansion of said cross tee said bulb end portion rides up over the bulb of the main beam and does not block such expansion.

8. For use in a fire-rated suspended ceiling grid, a cross tee as specified in claim 10 wherein the said bulb end portion of said cross tee has a slight bend therein whereby with said cross tee and another cross tee of similar construction oppositely disposed with respect to and coupled to an associated main beam and expansion of said cross tees said bulb end portions of said cross tees ride up over the bulb of the main beam and slides past the similar bulb end portion of the oppositely disposed cross tee.

9. For use in a fire-rated suspended ceiling grid, a cross tee as specified in claim 8 wherein a ramp edge is provided on the tongue of the cross tee for maintaining contact of said edge with an edge of the connecting slot in the associated main beam as the said bulb end portion rides up over the bulb of the associated main beam upon expansion of the cross tee.

10. For use in a fire-rated suspended ceiling grid, a main beam as specified in claim 1 wherein a transverse connecting slot is provided in the web of said main beam, and a cross tee associated with said main beam comprising an elongated web with laterally offset flanges at one edge and a bulb at the other edge whereby said cross tee has an inverted T cross section, and coupling means for coupling said cross tee to said connecting slot provided in the web of said main beam, said coupling means including a tongue extending from the end of said web, said tongue being offset by a crease line from said web by an amount approximating the thickness of said web and including a detent thereon whereby said tongue and the tongue of a similarly constructed but oppositely disposed cross tee may be seated and firmly retained in close parallel relationship in the said connecting slot of said main beam.

11. For use in a fire-rated suspended ceiling grid, a cross tee as specified in claim 10 wherein an end portion of the bulb of said web extends beyond said web, said portion being undercut and provided with an edge that inclines upwardly toward the end of said bulb portion, said bulb portion having a slight transverse bend and extending substantially to the bulb of said main beam with said cross tee in normal coupled relation with said main beam, whereby upon expansion of said cross tee said bulb end portion rides up over the bulb of the main beam and does not block such expansion and does not interfere with the expansion of a similarly constructed but oppositely disposed cross tee coupled to said main beam.

12. For use in a fire-rated suspended ceiling grid, a cross tee as specified in claim 11 wherein said bulb end portion of said cross tee has a slight bend therein whereby, with said cross tee and another cross tee of similar construction oppositely disposed with respect to and coupled to said main beam, upon expansion of said cross tees the bulb end portion of each of said cross tees rides up over the bulb of the said main beam and slides past the similar bulb end portion of the oppositely disposed cross tee, and wherein a ramp edge is provided on the tongue of each cross tee for maintaining contact of said ramp edge with an edge of the connecting slot in the web of said main beam as the said cross tee bulb end portions ride up over the bulb of the said main beam upon expansion of said cross tees.

13. For use in a fire-rated suspended ceiling grid as specified in claim 12 a main beam wherein a slit is provided in the end of the web near the lower edge thereof, the lead-in portion of said slit slanting downwardly from the main slit portion, and wherein said longitudinal slot of said main beam coupling means is of sufficient length to accommodate relative movement of said main beam from the normally coupled position of said main beam with another similarly constructed main beam.

14. For use in a fire-rated suspended ceiling grid, a plurality of main beams as specified in claim 1 coupled in end-to-end relationship and arranged in substantially the same plane in spaced-apart parallel relationship with a plurality of other similarly constructed and coupled main beams, and a plurality of cross tees associated with said plurality of main means, each of said cross tees comprising an elongated web with laterally offset flanges at one edge and a bulb at the other whereby each of said cross tees has an inverted T cross section, each of said cross tees being disposed substantially at a right angle to each of said plurality of main beams and having coupling means provided at each end for the coupling thereof to associated ones of spaced-apart main beams, said last mentioned coupling means including expansion relief means.

* * * * *